US006195950B1

(12) United States Patent
Harris

(10) Patent No.: US 6,195,950 B1
(45) Date of Patent: Mar. 6, 2001

(54) ENGINEERED STRUCTURAL MODULAR UNITS

(76) Inventor: Edwin Randall Harris, 613 Hillsboro Rd., Condo D-25, Franklin, TN (US) 37064

( * ) Notice: Subject to any disclaimer, the term of this patent is extended or adjusted under 35 U.S.C. 154(b) by 0 days.

(21) Appl. No.: 09/376,215

(22) Filed: Dec. 15, 1998

(51) Int. Cl.[7] ..... E04C 2/32

(52) U.S. Cl. ..... 52/270; 52/264; 52/274; 52/92.1

(58) Field of Search ..... 52/281, 243.1, 52/243, 241, 236.1, 90.1, 92.1, 92.2, 92.3, 233, 264, 266, 270, 271, 274, 268, 223.7, 223.6

(56) References Cited

U.S. PATENT DOCUMENTS 2,362,162 * 11/1944 Sheldon ..... 52/274
2,391,960 * 1/1946 Gede, Jr. ..... 52/274 X
2,521,381 * 9/1950 Linck ..... 52/270 X
3,236,014 * 2/1966 Edgar ..... 52/270
3,369,335 * 2/1968 Smith ..... 52/274 X
3,543,462 * 12/1970 Spratt et al. ..... 52/264
3,623,288 * 11/1971 Horowitz ..... 52/293.3
3,665,662 * 5/1972 Timbook et al. ..... 52/270 X
5,701,708 * 12/1997 Taraba et al. ..... 52/264 X
5,765,330 * 6/1998 Richard ..... 52/309.13

* cited by examiner

*Primary Examiner*—Richard Chilcot

(57) ABSTRACT

A modular house is constructed with Engineered Structural Modular Units (EMSU's) made from Stucturally Engineered Oriented Strand Boards (SEOSB's). Unitized structures are formed from modular units comprising two SEOSB panels with internal webbing for floor, wall, ceiling and roof modules; and adapter units such as corner adapter units, U-channel adapters, alignment connectors, trim adapters, and roof support adapters. Window and door openings can be cut on-site during construction. Any insulation meeting local building code requirements can be installed on-site. Standard electrical, plumbing, and mechanical products and procedures can be used as required by local building codes. All roofing and exterior wall coverings that meet local building codes can be used as required by architectural design.

3 Claims, 9 Drawing Sheets

ENGINEERED STRUCTURAL MODULAR UNITS

BACKGROUND OF THE INVENTION

1. Field of the Invention

The present invention relates generally to modular house construction with Engineered Structural Modular Units (EMSU'S). More specifically, unitized structures are formed from modular units comprising two structurally Engineered Oriented Strand Boards (SEOSB'S) with internal webbing, corner adapter units, alignment connectors, U-channel adapters, trim adapters, and roof support adapters, all made from SEOSB's. Modules comprising two SEOSB panels with internal webbing can be filled with insulating material such as either (1) wet-spray cellulose made from recycled paper products and treated with persistent fire retardants (preferred), (2) precut batting, preferably fiberglass with foil backing, (3) blown-in vermiculite or the like, or (4) any other insulation product that meets local building code requirements. Installation of all insulation is performed on-site and coordinated with the installation of necessary electrical, plumbing, and mechanical equipment. The ESMU system of construction not only dramatically simplifies the construction process, but it greatly reduces the man-hours required for on-site construction, thereby substantially reducing construction cost.

2. Description of Related Art

The related art of interest describe various modular units utilized in the construction of multi-room dwellings or the like. The related art will be discussed in the order of perceived relevance to the present invention.

U.S. Pat. No. 5,657,597 issued on Aug. 19, 1997, to William E. Loftus describes a building construction beginning with separate hooked foundation blocks upon which joined floor beams are placed. Two parallel floor beams have notches for placing floor trusses. Rectangular floor panels with notched sides are then laid and joined by keys. The walls are formed from grooved rectangular blocks mortared to further provide openings for doors and windows. The corners and top portions of the walls can be modified by adding concrete beams and metal rod cages for accommodating electrical wiring. The roof is constructed with trusses supported by soffit panels which are further attached modular gutter members. Rectangular roof panels with parallel notched sides are placed between the roof trusses and bonded with adhesive. The house construction components are distinguishable for relying on trusses.

U.S. Pat. No. 5,457,917 issued on Oct. 17, 1995, to Michael J. Palmersten describes interlocking expanded polystyrene (EPA) roof panels covered with a metal skin and with a built-in pitch. Urethane foam is not used. The panels are formed with the lower portions thinner in cross-section than the upper portions to permit the same height in the underlying rooms but having a pre-determined pitch to the roof. The foam and metal skinned panels interlock with metal hooks wherein one panel has square channel grooves. The pitched roof is distinguishable for its solid cross-section with a limited pitch.

Canada Patent No. 1,287,964 issued on Aug. 27, 1991, to Sidney K. Tissington et al. describes a wall panel comprising polyurethane foam insulation adhesively bonded to outer sheathing boards made from plywood or oriented strand wood reinforced with an additional 12 in. long header members inside and 3–4" base reinforcement members inside. Transverse bearing plates on top and at the bottom are provided with optional additional plates at both ends.

The sides of these panels have protrusions to bond with an intricate joint comprising flanged webs enclosing a foam insulation which is injected through holes in the bottom bearing plates with vent holes in both the upper and bottom bearing plates. Inside walls are gypsum. Windows and doors are framed and only small windows can be cut into the panels. However, these panels are distinguishable because they are not framed as a modular unit but formed in steps on site on vertical studs. For longer (or higher) panels, the studs can be placed horizontally.

U.K. Patent Application No. 1,183,055 published on Mar. 4, 1970, for Colin C. Kaines describes a building panel comprising double walled components made of either hardboard, plywood or asbestos connected in parallel by vertical webs held within the double wall component by hinged wooden lugs which are slid into the double walled components by vertical slots in the opposing inner walls. A double walled component contains a central core which can be honeycombed, cellular or molded pulp. 8 in. wide and 8 ft. high webs define the compartments and can be made of either plywood, metal or hardboard. The perforated compartments can be used for electrical wiring or filled with concrete or sand and used for shuttering in buildings. The building panel is distinguishable for requiring filling material other than insulation.

U.S. Pat. No. 5,609,003 issued on Mar. 11, 1997, to Chris G. Jouty describes a small storage shed constructed with rectangular floor, wall and roof sections, two L-shaped door mounting sections, and four triangular roof support sections. The sections are connected by special fastener systems including a bolt with nut and washer, and two aperture plugs with apertured shafts through which the bolt traverses. The panels are plywood with interior perimeter board frames. The storage shed is distinguishable for its limited load bearing construction.

U.S. Pat. No. 5,528,871 issued on Jun. 25, 1996, to Yvon Brodeur describes a self-aligning, self-interlocking, and self-resisting modular building kit comprising rectangular floor and wall panels joined by tongue and groove construction and made from 0.25 to 0.75 in. particle boards on a concrete foundation. The panels have centered girders and an open interior surface. Apparently, the roof construction is flat. The building kit is distinguishable for its omission of doors, windows, a gable, and reliance on particle boards.

U.S. Pat. No. 5,425,214 issued on Jun. 10, 1995, to Andrew R. Truelove et al. describes an elevated modular floor assembly for a temporary exhibition and resting on either a concrete or ground floor surface. The rectangular panels interlock along their long sides. The frames are made from extruded aluminum. The modular floor assembly is distinguishable for its metallic and temporary construction.

U.S. Pat. No. 5,546,722 issued on Aug. 20, 1996, to Yen T. Huang describes a modular gabled roof structure made from tubular metal, strengthened by guy wires, based on a rectangular channeled base frame and covered by canvas. The ridge portion is joined by two turnbuckles which permit adjustable length and dismantling into three roof sections. The roof structure is distinguishable for its temporary nature.

None of the above inventions and patents, taken either singly or in combination, is seen to describe the instant invention as claimed.

SUMMARY OF THE INVENTION

The present invention is directed to the construction of modular buildings using ESMU'S. These unitized structures are formed from modular units comprising SEPOBS with internal webbing, corner adapter units, trim adapters, alignment connectors, U-channel adapters, and roof support adapters. A rectangular module consisting of two SEOSB panels bonded to SEOSB internal webbing, creates the basic building block from which a unitized, bonded modular building can be erected. The unitized bonded building can withstand extreme stresses and can be built from an assembly kit which requires a minimum of construction skills or knowledge to assemble and relatively few man-hours to complete, thereby reducing cost and providing a more energy efficient and environmentally friendly structure.

Accordingly, it is a principal object of the invention to provide Engineered Structural Modular Units.

It is another object of the invention to provide Engineered Structural Modular Units for the construction of a building.

It is a further object of the invention to provide Engineered Structural Modular Units for the construction of floors and walls.

Still another object of the invention is to provide an Engineered Structural Modular Unit for the construction of ceilings and roofs including roof support modules and gable modules.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an economical house constructed with Engineered Structural Modular Units to meet local building code requirements. The house can be assembled with limited manpower in a relatively short period of time by workers with limited construction knowledge or skills and without special tools or other equipment.

Figure 1:
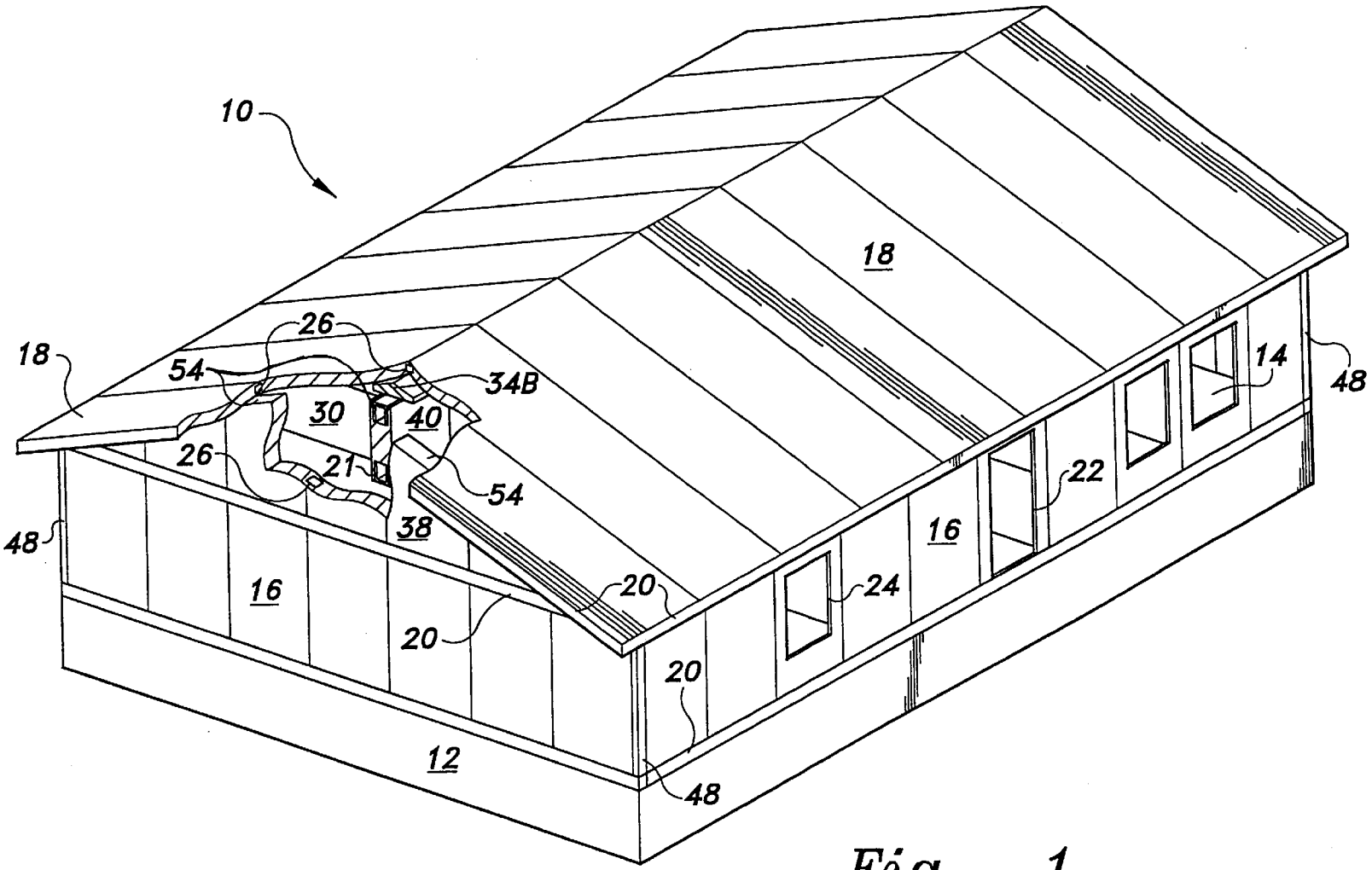
FIG. 1 is perspective view of a house built with Engineered Structural Modular Units according to the present invention.

In FIG. 1, a substantially completed house 10 on a concrete foundation 12 as illustrated is made from a kit comprising floor modules 14, wall modules 16, gable modules 38, roof modules 18, corner adapter units 48, ceiling modules, 30, and roof support modules 40. Outside trim adapters 20 finish exposed module perimeters. Door openings 22 and window openings 24 are cut out during assembly. A cutaway section of roof modules 18 reveals cross-sections of alignnment connectors 26, U-channel adapters 21, inverted U-channel adapters 54, and the roof support adapter 34B.

Figure 2:
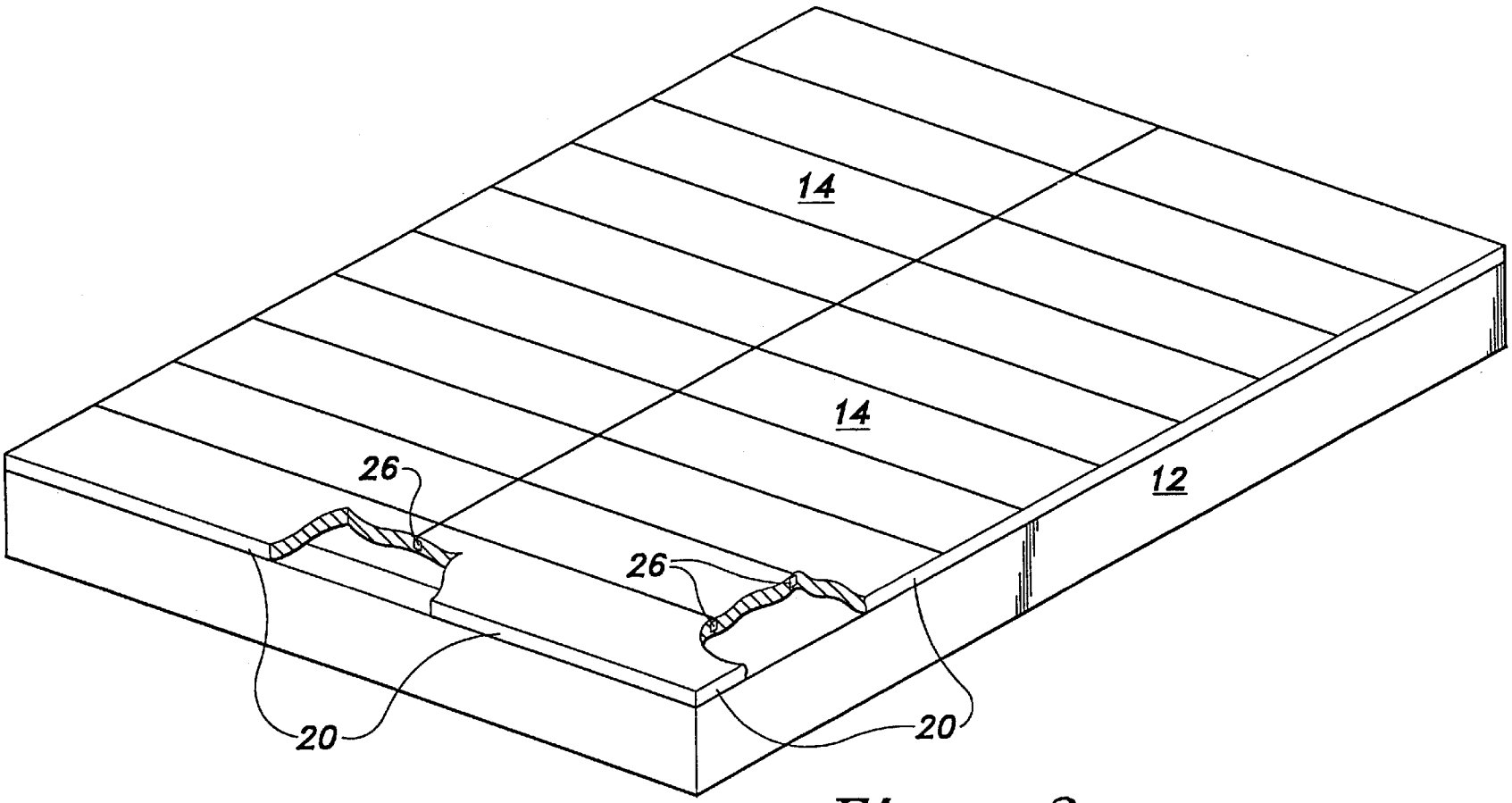
FIG. 2 is a view of a floor system using Engineered Structural Modular Units with two partial breakaways exposing a cross-section of three alignment connectors, which are used to align and connect Engineered Structural Modular Units.

FIG. 2 depicts the first step in Engineered Structural Modular Unit assembly which is the assembly of the rectangular floor modules 14 installed over a concrete foundation 12. Cross-sections of three alignment connectors 26 which join the floor modules 14 are shown in the cutaway sections. Due to the scale of the drawing, the internal structure of each floor module 14 (see FIG.7) in the cutaway portion is not shown. The trim adapters 20 finish the exposed perimeter of each floor module 14.

Figure 3:
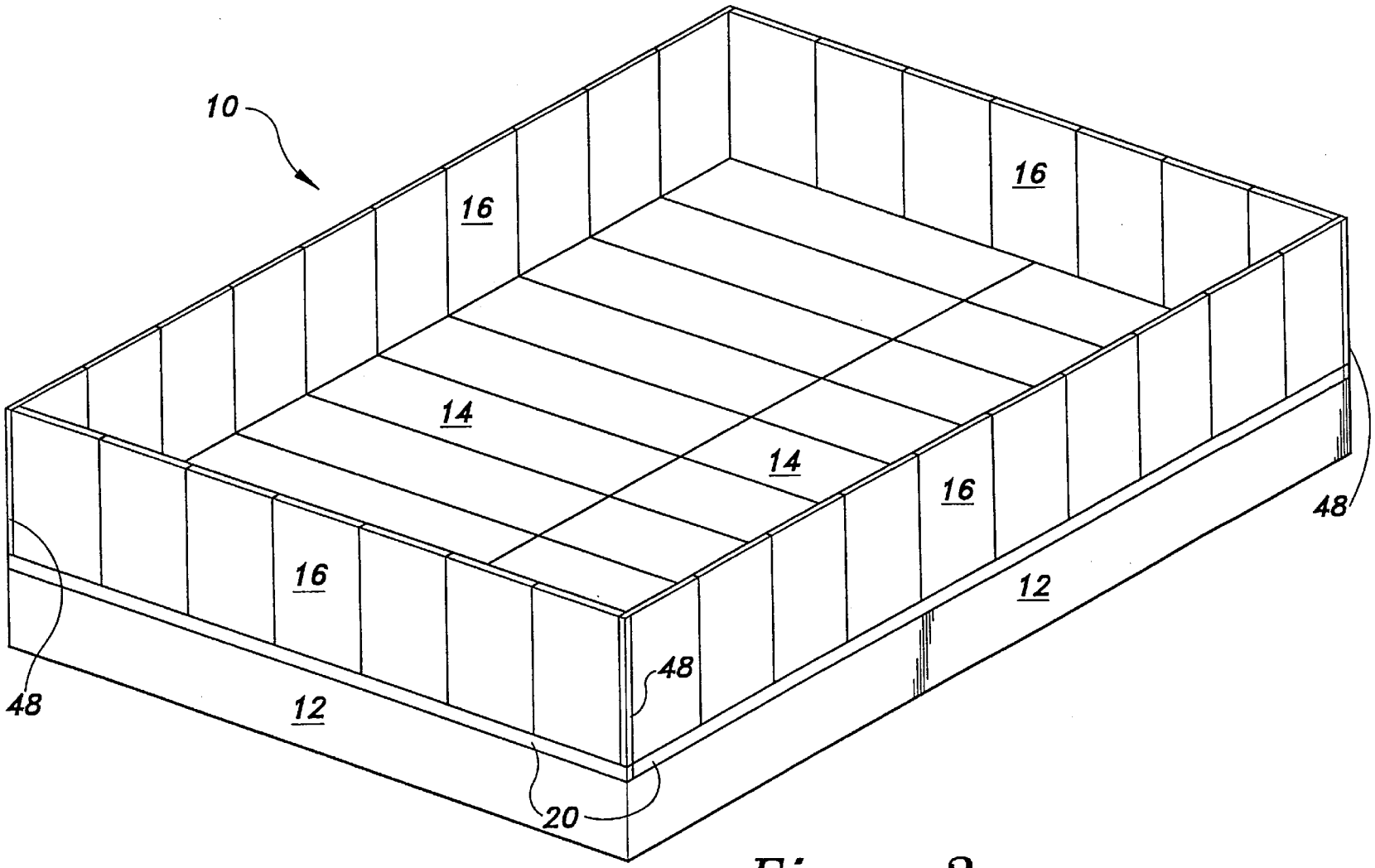
FIG. 3 is a perspective view of an exterior wall system using Engineered Structural Modular Units.

In FIG. 3, the wall modules 16, the corner adapter units 48 and the U-channel adapters 21 (hidden) have been installed over the floor modules 14 to form the exterior walls of the house 10.

Figure 4:
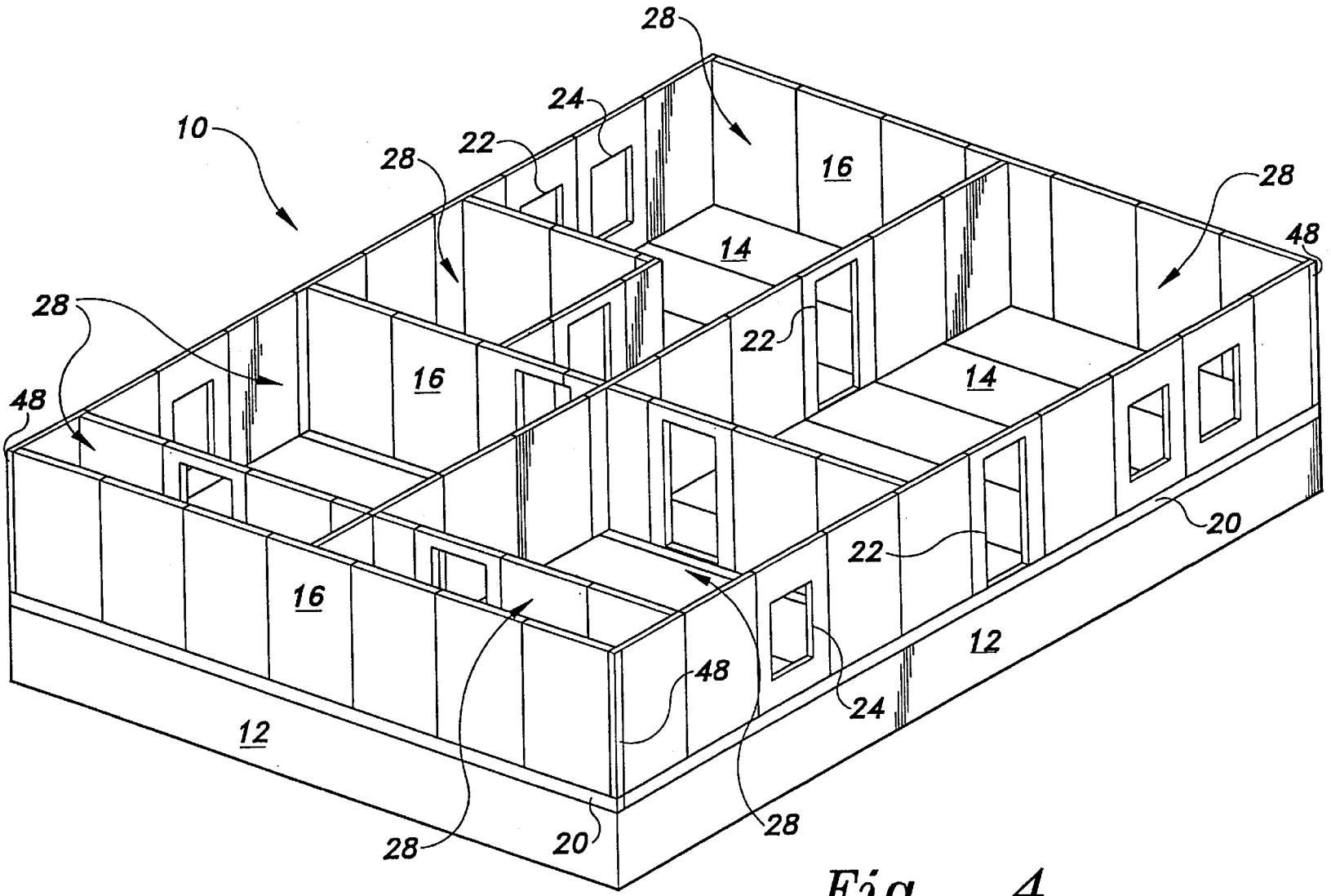
FIG. 4 is a perspective view of an interior wall system using Engineered Structural Modular Units.

In FIG. 4, the interior walls and seven rooms 28 are formed by erecting wall modules 16 over the U-channel adapters 21 (hidden) which are bonded to the floor modules 14. The wall modules 16 are joined with the alignment connectors 26 (hidden). Inverted U-channel adapters 54 are installed in the channel provided in the top of the wall modules 16 as in FIG. 9. Inside and outside door openings 22 and window openings 24 are shown cut out from the wall modules 16.

Figure 5:
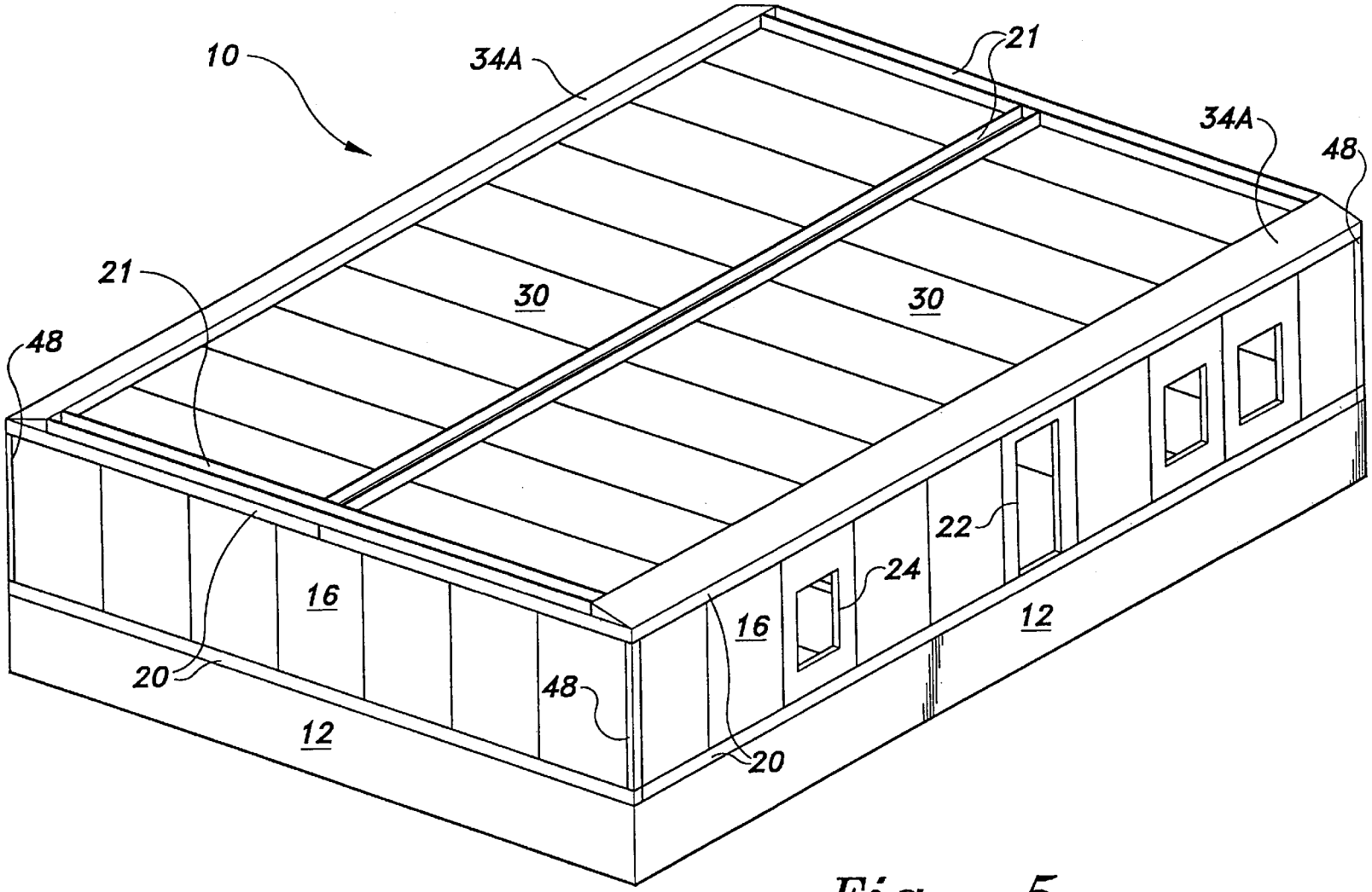
FIG. 5 is a perspective view of a ceiling system using Engineered Structural Modular Units.

In FIG. 5, ceiling modules 30 are positioned and joined using alignment connectors 26 (hidden). U-channel adapters 21 are positioned as required for the location and proper alignment of roof support modules 40 and gable modules 38 (see FIG. 6). The outer roof support strips 34A are precut according to roof pitch.

Figure 6:
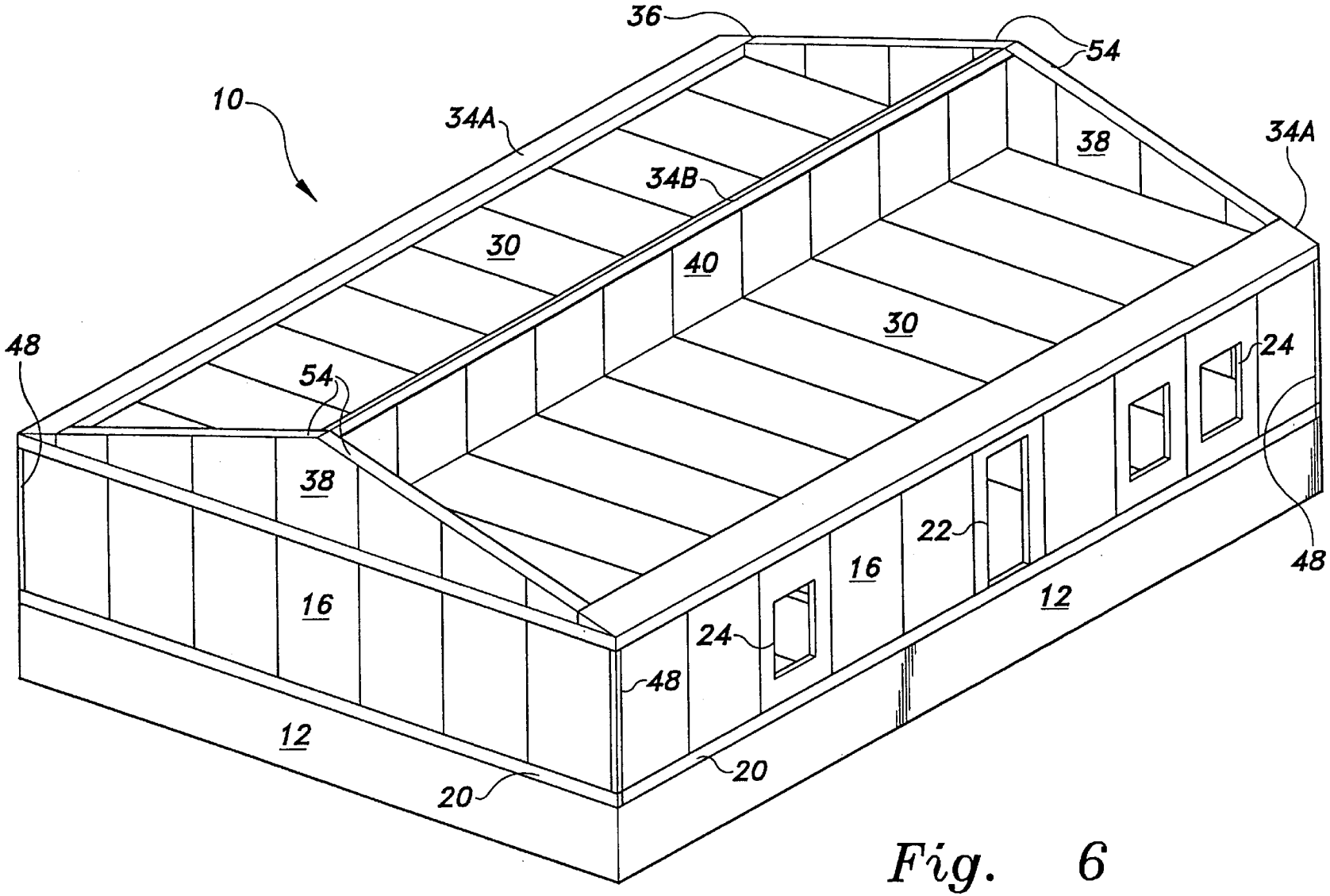
FIG. 6 is a perspective view of a roof support system using Engineered Structural Modular Units.

In FIG. 6, gable modules 38 with predetermined pitch 36 are positioned at each end of the house 10 and are joined vertically by alignment connectors 26 (hidden but shown in FIG. 1)). Roof support modules 40 are installed and joined together vertically using alignment connectors 26 (hidden). Inverted U-channel adapters 54 are positioned in the gable modules 38 and in the roof support modules 40. A mitered roof support adapter 34B connects to the inverted U-channel adapter 54 (hidden) in the roof support modules 40.

Figure 7:
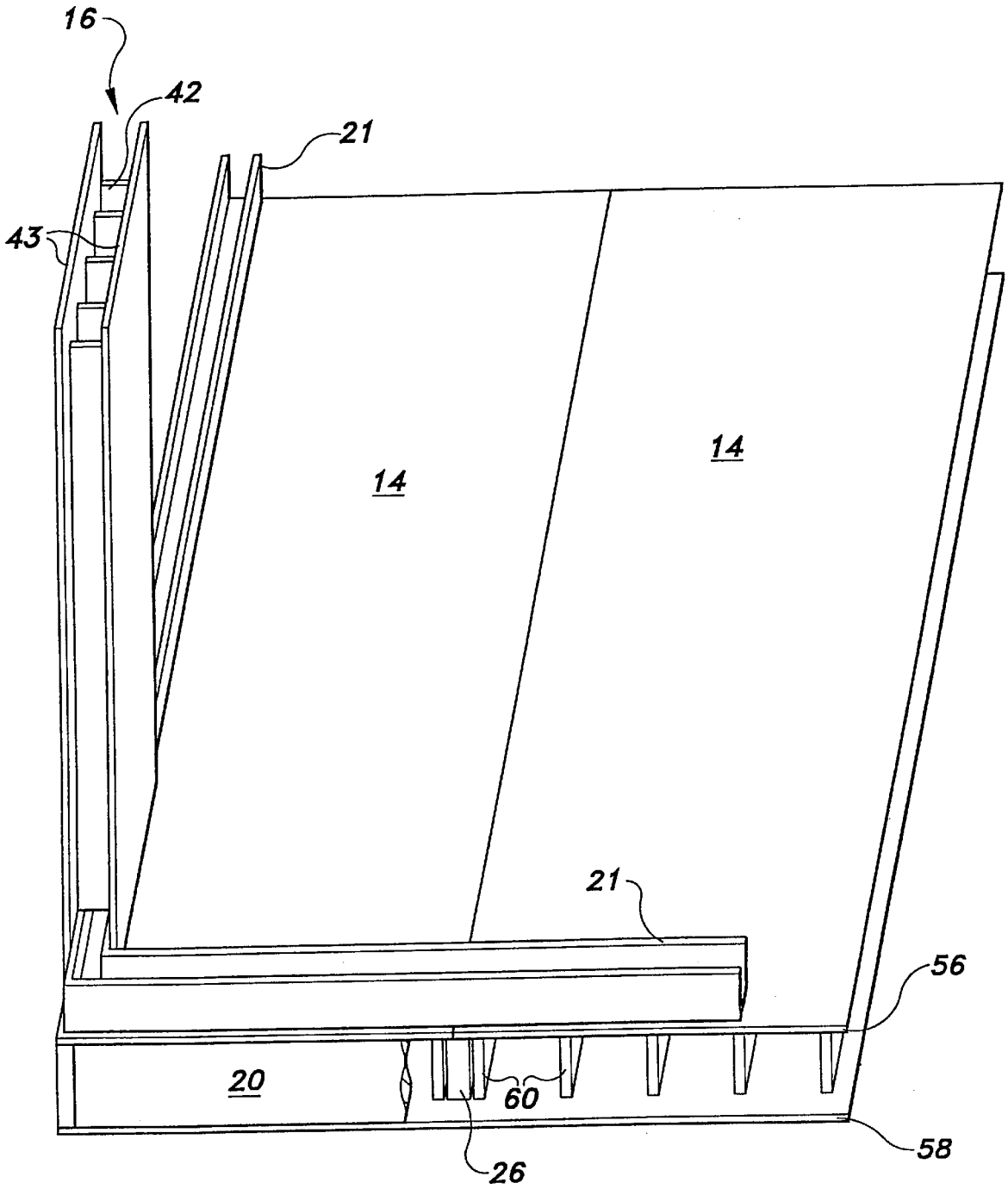
FIG. 7 is a perspective view of a wall module positioned over a U-channel adapter which is attached to two floor modules.

In FIG. 7, a critical aspect of the positioning of a wall module 16 and a floor module 14 using U-channel adapters 21 is illustrated, showing the typical relationship of the vertical module to the horizontal module and how the U-channel adapter 21 and/or the inverted U-channel adapter 54 (see FIG. 9) are/is used when the vertical and horizontal modules intersect. Wall modules 16 are adhesively bonded to the U-channel adapters 21 and to the floor modules 14. The wall modules 16 are manufactured with two 4 ft. wide, 8 ft. long and at least 7/16 in. thick panels 43 made of Engineered Structural Oriented Strand Board (ESOSB) bonded to five ESOSB web pieces 42 which are 7 ft. 6 in. in length (centered), 5 in. in width and at least 5/8 in. in thickness to provide channels 44 at both ends of the wall modules 16.

The ceiling modules 30 and the roof modules 18 are made of the same materials and have substantially the same dimensions as the wall modules 16 with the exception of the lengths which are 12 ft. for the ceiling modules 30 and 16 ft. for the roof modules 18.

The floor modules 14 are manufactured with two 4 ft. wide, 12 ft. in length panels, with the upper panel 56 being ⅝ in. in thickness or greater, and with the lower panel 58 being 7/16 in. in thickness, and with the web pieces 42 being ¾ in. in thickness or greater, 9 in. in height and 11 ft. 9 in. in length (centered). Both webb pieces 42 and panels 43, 56 and 58 are made of ESOSB material.

Module dimensions are determined by architectural specification as related to design and/or load requirements. U-channel adapters 21 are also made from ESOSB and are adhesively bonded to the floor modules 14 as required by specification. The cutaway section of the trim adapter 20 in FIG. 7 reveals a cross-section of an alignment connector 26 and a portion of the internal webbing 60.

Figure 8:
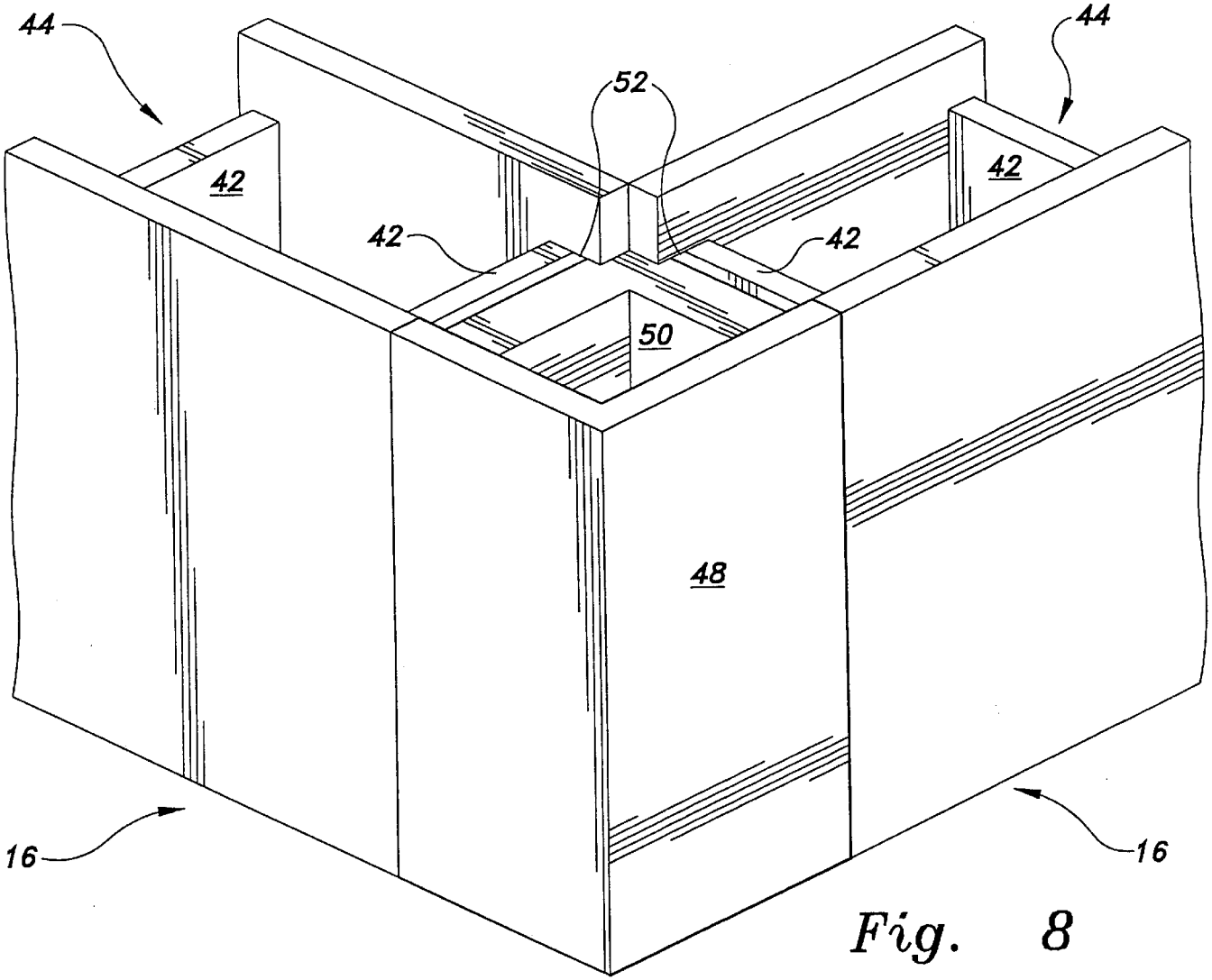
FIG. 8 is a perspective view of a panel corner with a corner adapter unit.

In FIG. 8, a section of a typical wall corner is shown using a corner adapter unit 48 and two wall modules 16. The corner adapter unit 48 is manufactured from ESOSB material with its dimensions compatible to the wall module 16. The corner adapter unit 48 is adhesively bonded to the vertical U-channel or cutout 52 of the inner panel of the wall module 16, the floor module 14 (not shown), the U-channel adapter 21 (not shown), and the ceiling module 30 (see FIGS. 5 and 6). The length of the interior wall 50 of the corner adapter unit 48 is the same length as the wall module webbing 42 which is 7 ft. 6 in. (centered). The structure of the corner adapter unit enables the continuation of the channel 44 which receives the U-channel adapters 21 and the inverted U-channel adapters 54.

Figure 9:
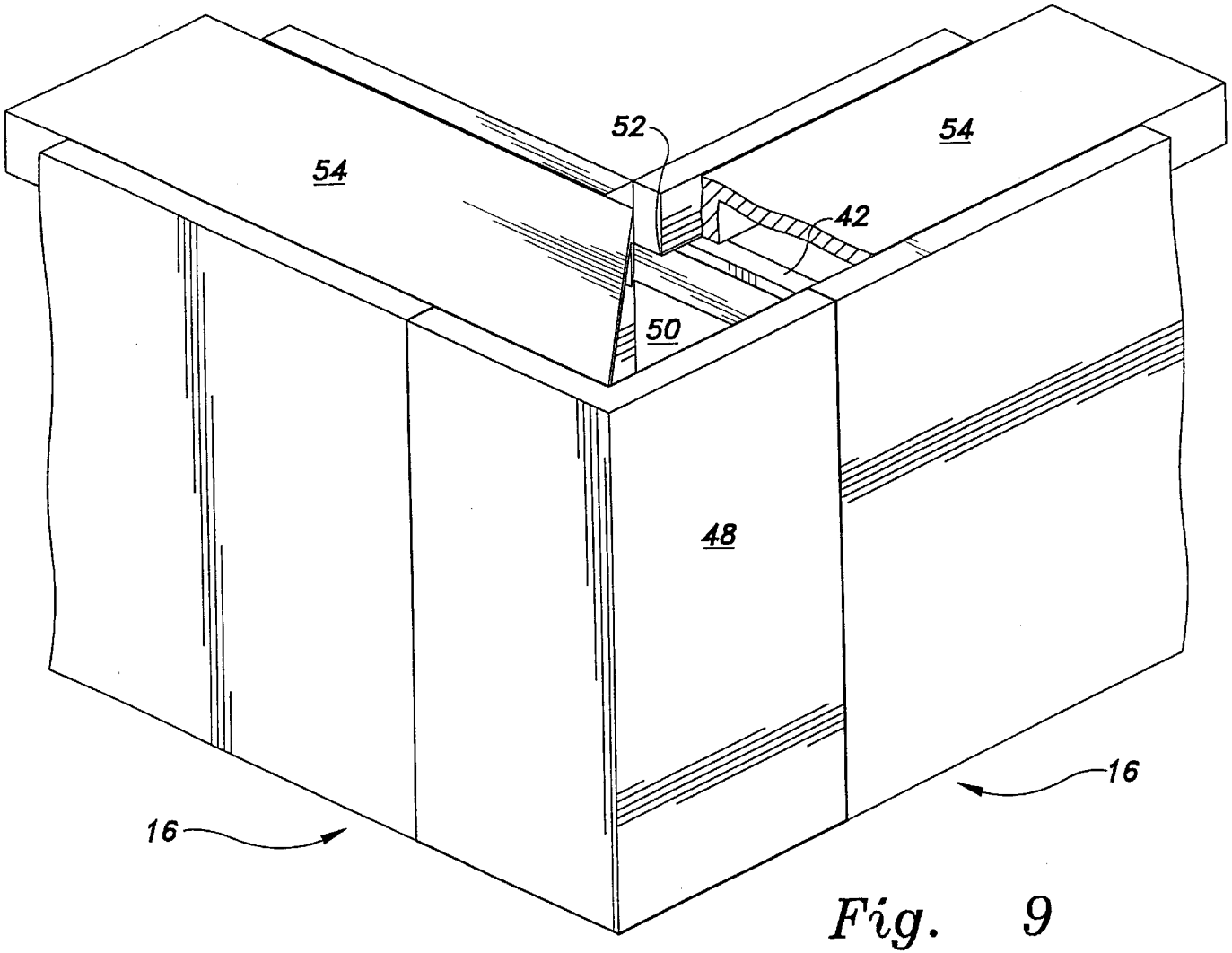
FIG. 9 is a perspective view of two U-channel adapters, as used in a section of a wall corner assembly, with a unitary corner adapter and with partial cutaway of a U-channel adapter.

In FIG. 9, an inverted U-channel adapter 54 with a 45° miter is inserted into a typical wall corner section using a corner adapter unit 48 and two wall modules 16. The cutaway section of the inverted U-channel adapter 54 illustrates the spatial relationship between the wall modules 16, the corner adapter unit 48 and the two inverted U-channel adapters 54.

Thus, the economical house 10 provides the significant advantages of reduced construction time, reduced construction cost, reduced energy consumption, and reduced timber harvesting. Reduced construction time results in lower labor cost and increased production. Reduced construction cost relates to the reduction of the material cost due to the use of Engineered Structural Modular Units which are manufactured on an automated assembly line. The combined reduction in cost of both labor and materials will open up the housing market to millions of people who are currently priced out of the market. Energy consumption will be reduced both during construction and as it relates to annual heating and cooling. Environmental necessity demands reduction in the harvesting of mature and old growth timber worldwide, a problem directly addressed by the manufacture of Engineered Structural Modular Units of the present invention.

It is to be understood that the present invention is not limited to the embodiments described above, but encompasses any and all embodiments within the scope of the following claims.

I claim:

1. Engineered Structural Modular Units for housing construction comprising:

floor modules, wall modules, ceiling modules, roof modules, roof support modules, and gable modules, each comprising two wooden panels having a longitudinal axis separated by a plurality of wooden webs positioned along the longitudinal axis;

wooden U-channel adapters for anchoring and aligning all vertical modules when applied to floor, ceiling or roof modules;

integrated wooden corner adapter pieces abutting U-channel adapters;

wooden alignment connectors to align and bond to all perimeter module surfaces when connecting modules on the same plane;

wooden trim adapters to provide a flush finished edge for exposed module perimeters; and wooden roof support adapters to support and connect roof modules;

whereby every part in the housing construction is bonded by adhesive and the openings for windows and doors are cut out on-site.

2. The Engineered Structural Modular Units according to claim 1, including insulation insertable in each floor, wall, ceiling, roof, and gable module as required.

3. The Engineered Structural Modular Units according to claim 1, wherein each wooden element is made from Engineered Structural Oriented Strand Board.

* * * * *